United States Patent [19]

Katsuma et al.

[11] Patent Number: 4,488,145

[45] Date of Patent: Dec. 11, 1984

[54] RESONANT SOUNDER DEVICE FOR PRODUCING MULTIPLE WARNING SOUNDS

[75] Inventors: Makoto Katsuma; Kiyoshi Alyfuku; Masaharu Kawamura; Masayoshi Kiuchi, all of Kanagawa; Hiroyasu Murakami, Tokyo, all of Japan

[73] Assignee: Canon Kabushiki Kaisha, Tokyo, Japan

[21] Appl. No.: 336,496

[22] Filed: Dec. 31, 1981

[30] Foreign Application Priority Data

Jan. 16, 1981 [JP] Japan ..... 56-5637

[51] Int. Cl.[3] ..... G08B 21/00

[52] U.S. Cl. ..... 340/384 E; 310/317; 340/679

[58] Field of Search ..... 340/384 E, 679; 310/317, 311

[56] References Cited

U.S. PATENT DOCUMENTS

| | | | |
|---|---|---|---|
| 3,872,470 | 3/1975 | Hoerz et al. | 340/384 E |
| 4,023,162 | 5/1977 | Murakami | 310/317 |
| 4,193,060 | 3/1980 | Slavin et al. | 340/384 E |
| 4,195,284 | 3/1980 | Hampshire et al. | 340/384 E |
| 4,206,448 | 6/1980 | Davis | 340/384 E |
| 4,224,613 | 9/1980 | Kaiser et al. | 340/384 E |
| 4,272,176 | 6/1981 | Maitani et al. | 354/238.1 |
| 4,396,909 | 8/1983 | Suzuki | 340/384 E |

FOREIGN PATENT DOCUMENTS 1297461 6/1969 Fed. Rep. of Germany .

*Primary Examiner*—Glen R. Swann, III

*Attorney, Agent, or Firm*—Toren, McGeady and Stanger

[57] ABSTRACT

The present invention produces at least two sound signals such as warning signals or actuating signals by one sounder having a resonant frequency, wherein one of the sound signals is indicated by the resonant frequency of the sounder to enable a higher intensity sound to be produced.

2 Claims, 4 Drawing Figures

RESONANT SOUNDER DEVICE FOR PRODUCING MULTIPLE WARNING SOUNDS

BACKGROUND OF THE INVENTION

1. Field of the Invention

This invention relates to a drive circuit for sounders having a resonant frequency such as piezo-electric buzzers and microphones.

2. Description of the Prior Art

Such sounders, because of their small size and light weight, have found many uses in various fields of art, for example, in cameras and sound instruments. There is a high probability that they will be used in the near future even in the art of motion picture instruments such as video cameras.

A technique in which the out-of-range low light value is indicated by a sound signal from the speaker built into the camera is described in German Pat. No. 1297461.

Another technique in which a plurality of sound signals are formed by one sounder, and, as the sound type is changed, a plurality of warning signals are controlled is shown in U.S. Pat. No. 3,872,470.

Furthermore, even in the camera art, the audio warning signal representing filming end is disclosed in U.S. Pat. Nos. 3,776,652, and 4,272,176 discloses a single sounder providing different audio signals a self-timer-under-operation signal and an out-of-range low brightness signal.

SUMMARY OF THE INVENTION

It is an object of the present invention to provide a drive circuit so constructed that the use of a single sounder suffices to produce a plurality of sound signals representing the fact that the instrument is under operation, or warnings, wherein one of the actuating and warning signals which is to be particularly indicated is indicated with high sound intensity.

Another object of the present invention is to provide a drive circuit of the character described above as applied to a single lens reflex camera, a video camera, or other imaging instrument, whereby the self-timer-under-actuation signal, the warning signal representing a setting of improper exposure factors such as extraordinary low brightness, a warning signal showing that a film is inaccurately loaded, or that a fresh area of the film is no longer available. Another warning signal shows that the actual battery voltage is below a satisfactory operating level, that is, a plurality of actuating and warning signals are selectively informed by sound from a single sounder, wherein one of the signals which lets the operator know most effectively is produced in the form of a particularly high pressure sound.

DESCRIPTION OF THE PREFERRED EMBODIMENT

The present invention is described with an embodiment thereof by reference to the drawings.

Figure 1:
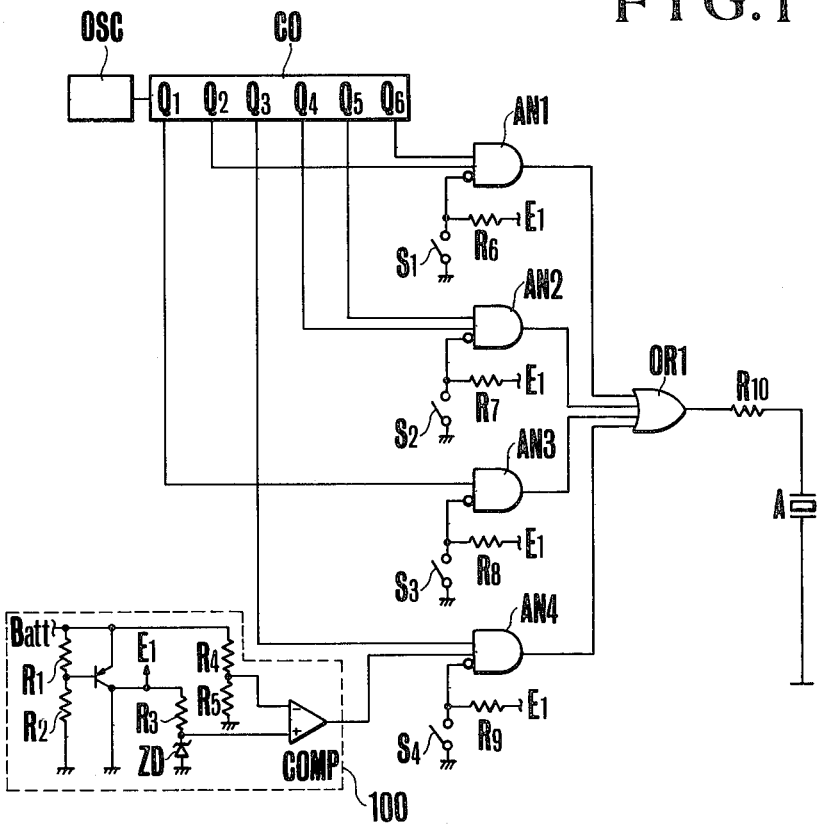
FIG. 1 is a schematic view of an electrical circuit diagram of an embodiment of the present invention.

FIG. 1 is an electrical circuit diagram of a warning device in the camera to which the present invention is applied. An oscillator OSC has an output terminal which is connected to a frequency divider or counter CO. The frequency divider or counter CO has an output terminal Q1 at which pulses of 8 KHz are produced, an output terminal Q2 at which pulses of 4 KHz are produced, an output terminal Q3 at which pulses of 2 KHz are produced, an output terminal Q4 at which pulses of 1 KHz are produced, an output terminal Q5 at which pulses of 4 Hz are produced and an output terminal Q6 at which pulses of 2 Hz are produced. The output terminals Q1 to Q6 are all connected to respective inputs of AND gates AN1 to AN4 in the manner illustrated in FIG. 1. A normally open switch S1 is closed when a self-timer (not shown) is under operation; a normally open switch S2 is closed when the object brightness is too low. It is noted that the switch S2 is depicted in FIG. 1 as a mechanical switch, but in the case of an actual circuit, it is an electronic switching element operable by a low brightness warning signal from a brightness warning circuit (not shown). A normally open switch S3 is closed when the film is no longer supplied; a normally open switch S4 is closed when the output voltage of a battery is to be checked; the resistors R6 to R9 are connected between a constant voltage source E1 and the respective connection points between the switches S1 to S4 and the AND gates AN1 to AN4. The resistors R1 to R5 are provided in a battery voltage checking circuit 100. The circuit also includes Zener diode ZD; a comparator COMP; an OR gate OR1; a sounder A having a resonant frequency of 4KHz and having one lead connected through a resistor R10 to the output of the OR gate OR1 and the opposite lead connected to the circuit ground.

Figure 3A:
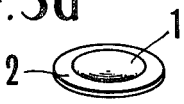
FIGS. 3(*a*) and 3(*b*) are perspective views of the sounder.
Figure 3B:
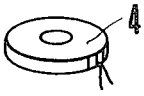

FIG. 3(*a*) illustrates the structure of the sounder A in which a piezo-electric element in the form of a disc-like thin plate 1 is secured to a metal plate 2. For example, a thin film of piezo-electric porcelain such as lead titanate, zirconate adhered to a titanium or brass plate is used as a sounder element. This element is supported at the periphery or the node of vibration by the framework of the camera and is connected to the drive circuit of FIG. 1.

FIG. 3(*b*) illustrates a casing 4 of the sounder element with the lead wires attached.

The operation of the warning device of such construction is as follows:

For example, as a shot is made with the use of the self-timer, when the switch S1 is closed, the AND gate AN1 responsive to simultaneous occurrence of the outputs Q2 and Q6 of high level (hereinafter abbreviated by "H" level) from the counter CO produces a drive signal with a frequency determined by the frequencies of the pulses from the output terminals Q2 and Q6. Therefore, the sounder A is driven by a drive signal which produces a sound informing the photographer that the self-timer is going on.

On the other hand, when the switch S2 is closed, the AND gate AN2 produces a drive signal with a frequency determined by the frequencies of the pulses from the output terminals Q4 and Q5 of the counter CO. Therefore, at this time, the sounder A is driven by a drive signal which produces a sound informing the photographer that the object brightness is too low to obtain a correct exposure.

As the film footage advances, when no more unused film is available, the switch S3 is closed, thereby the AND gate AN3 is gated "on" to pass the pulses from the output terminal Q1 of the counter CO therethrough to the sounder A, informing the photographer that it is time to replace the film with a new one.

To check the battery voltage, the photographer will close the switch S4. If the actual voltage of the battery Batt is lower than a predetermined level set on the Zener, the AND gate AN4 produces a drive signal in the form of pulses from the output terminal Q3 of the counter CO, informing the photographer that the output voltage of the battery Batt falls below the satisfactory operating level.

Figure 2:
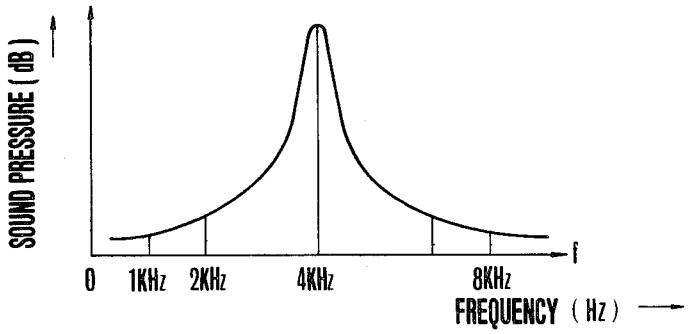
FIG. 2 is a graph illustrating variation of the sound pressure of the sounder with the frequency at which the sounder is driven.

When a self-timer exposure or shot is being made the sounder A is driven at 4 KHz equal to the resonant frequency thereof, thus, sound intensity is extraordinarily strong as illustrated in FIG. 2. This enables even a photographer posing far away from the camera to be aware of when the self-timer takes a shot. When in other modes, the camera is in the photographer's hands, the sounder A is driven at frequencies outside the resonant frequency thereof, thus indicating all other modes by respective sounds of far weaker intensity than in the self-timer mode.

According to the present invention, only one sounder suffices to display a plurality of sound signals, namely, the self-timer actuating signal, the under-exposure of film-warning signal, the filming end signal, and the battery voltage level or fall-out warning signal. Furthermore, the one signal which requires such a wide spread sound that the photographer can be clearly notified with the particular information displayed by extracting from the aforesaid frequency divider or counter a pulse train of frequency equal to the resonance frequency of the sounder and applying this pulse train to that portion of the circuit (AND circuit portions) which is responsive to that signal which requires strong sound, in this instance, a self-timer actuating signal.

According to the present invention, the plurality of sound signals all have the same amplitude except for the mode that operates with the resonant frequency of the sounder indicated by a higher intensity sound. Therefore, the drive circuit for the sounder can be constructed in a simple form as will be seen from the illustrated embodiment of FIG. 1.

A practical example of the sounder having the resonance frequency at 4 KHz can be constructed in accordance with the following data: The metal plate 2 of the sounder is made of a brass disc plate having a diameter of about 18.5 mm with a thickness of 0.1 mm. The piezoelectric element is made of ceramic having a diameter of 14 mm with a thickness of 0.25 mm.

What is claimed is:

1. A warning device comprising:

(a) a sounder having a resonant frequency and capable, upon being driven at said resonant frequency, of producing a relatively high sound intensity;

(b) an oscillator and a frequency dividing counter, a signal from said oscillator being applied to said frequency dividing counter, said frequency dividing counter producing a plurality of output pulse signals of divided frequencies;

(c) at least two warning signal forming means for indicating warnings by the sound signals of said sounder; and (d) a circuit for actuating said sounder, said actuating circuit being responsive to the output signals of said frequency dividing counter and said warning signal forming means to indicate warning states by sound signals corresponding to the frequencies from said frequency dividing counter, whereby one of the sound signals for said warning states is made to have a frequency equal or near to the resonant frequency of said sounder.

2. A warning device according to claim 1, wherein said warning signal forming means are any two of a 1st signal forming means for informing of actuation of a self-timer in a camera, a 2nd signal forming means for informing of an improper exposure, a 3rd signal forming means for warning of the filming end, and a 4th signal forming means for warning of an abnormal condition of the voltage source in the camera.

* * * * *